United States Patent [19]

Seragnoli

[11] 4,181,561

[45] Jan. 1, 1980

[54] LABELLING DEVICE

[75] Inventor: Enzo Seragnoli, Bologna, Italy

[73] Assignee: G. D. Societa per Azioni, Bologna, Italy

[21] Appl. No.: 858,632

[22] Filed: Dec. 8, 1977

[30] Foreign Application Priority Data

Dec. 13, 1976 [IT] Italy ..... 3610 A/76

[51] Int. Cl.[2] ..... B65C 1/02; B65C 1/06

[52] U.S. Cl. ..... 156/566; 156/475; 156/571; 156/DIG. 2; 156/DIG. 4

[58] Field of Search ..... 156/566, 569, 570, 571, 156/572, DIG. 4, DIG. 1, DIG. 2, DIG. 3, 475

[56] References Cited

U.S. PATENT DOCUMENTS

| | | | |
|---|---|---|---|
| 3,232,815 | 2/1966 | Klopfenstein et al. | 156/571 |
| 3,428,509 | 2/1969 | Messmer | 156/566 |
| 3,616,094 | 10/1971 | Navin | 156/571 |

*Primary Examiner*—John T. Goolkasian
*Assistant Examiner*—William H. Thrower
*Attorney, Agent, or Firm*—H. Dale Palmatier

[57] ABSTRACT

A labelling device, particularly for applying a label to cigarette packets, and in which a shaft having at one end a label retaining member is mounted in a rotatable and axially slidable manner through a casing, which is supported by a support member so as to be oscillable relative thereto through an angle about an axis at right angles to said shaft; said support member being adjustable in position, and said casing enclosing first transmission means cyclically displacing said shaft axially relative to said casing to bring said label retaining member into a label application position, and second transmission means which are adjustable to a position in which they connect said casing and said shaft to one another so as to transform the oscillations of the casing into rotations of the shaft about its axis and relative to the casing.

3 Claims, 20 Drawing Figures

LABELLING DEVICE

BACKGROUND OF THE INVENTION

This invention relates to a labelling device particularly adapted to be associated to a machine for packaging cigarettes into hinged lid packets, to apply a State stamp or, more generally, a label to said packets.

More particularly, this invention relates to a labelling device adapted to be mounted in a fixed position along a conveyor for transferring said packets from said packaging machine to a wrapping machine, in which said packets are wrapped in sheets of transparent material (cellophane or polypropylene).

It is known that labels are applied to packets of cigarettes in many different arrangements, in accordance with the most varied requirements.

Hitherto a different labelling device has been used for each of the above arrangements so that any change in the position of the label corresponds to an expensive and time consuming change of at least a substantial portion of the labelling device.

SUMMARY OF THE INVENTION

It is an object of the present invention to provide an adjustable labelling device capable to apply a label or State stamp on packets of cigarettes in each of a number of different arrangements.

According to the invention there is provided a labelling device, particularly for applying a label to packets, in particular cigarette packets of the hinged lid type, arranged flat on a support plane and advanced transversely therealong in a step-by-step manner; the labelling device comprising a feeding device (15) for feeding in succession individual labels to a take-up position; stop means (86) for stopping in succession each said packet on said support in an application position at which the respective label is applied; a support member (6) the position of which is adjustable relative to said support plane in two directions parallel thereto and at right angles to one another, one of said two directions being parallel to the direction of advancement of said packets; a casing (18) connected to said support member (6) so as to be rotatable relative thereto about an axis parallel to said support plane and at right angles to said advancement direction; first actuating means (37) operable cyclically to oscillate said casing (18) at a predetermined frequency about said axis through an angle; a main shaft (55) extending through said casing (18) in a rotatable and axially slidable manner and arranged at right angles to said axis; a label retaining means (57) connected to said main shaft (55) and oscillable therewith and said casing (18) about said axis throgh said angle between said take-up position and a ready-to-work position arranged above said application position; second actuating means (28-70-71) operable cyclically at the same frequency as said first actuating means to displace axially said label retaining means (57) between said ready-to-work position and said application position; and transmission means (47-50-64) adjustable between a coupled position and a decoupled position to transform, when arranged in said coupled position, the oscillation of said casing (18) through said angle into a rotation of about 90° of said label retaining means (57) about the axis of said main shaft (55).

BRIEF DESCRIPTION OF THE DRAWINGS

The invention will be described by way of example with reference to the accompanying drawings, in which.

DETAILED DESCRIPTION OF THE INVENTION

FIGS. 1 to 10 show the various types of arrangement for a label 14 substantially rectangular in shape when applied to hinged lid packets 3, and distinguishable as a first group (FIG. 1, 2, 3, 4, 5 and 6), in which label 14 is applied transversely to the major dimension of the respective packet 3, and a second group (FIG. 7, 8, 9, 10), in which label 14 is applied longitudinally to said dimension.

Figure 1:
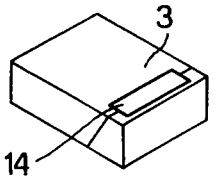
FIGS. 1 to 10 are each a perspective view of a packet of cigarettes provided with a label arranged in a different position.
Figure 2:
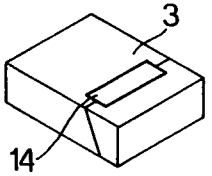

More precisely, with regard to the first group, in FIG. 1 label 14 is applied over its whole lenght along the hinging line of the respective packet 3. In FIG. 2, label 14 is applied to the opposite face of packet 3 along its closure line.

Figure 3:
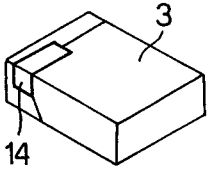
Figure 4:
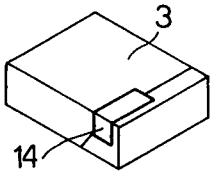

The cases shown in FIGS. 3 and 4 may be considered derived from the case shown in FIG. 1 by sliding label 14 towards the right (FIG. 3) or towards the left (FIG. 4), to a sufficient extent to enable one of its ends to be folded over the adjacent side of the respective packet 3.

Figure 5:
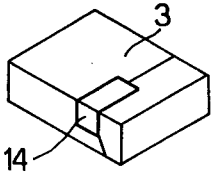
Figure 6:
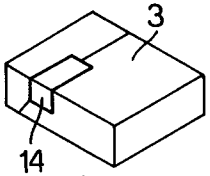

The cases shown in FIGS. 5 and 6 may be considered derived from the cases shown in FIG. 2 by sliding label 14 towards the left (FIG. 5) or towards the right (FIG. 6) to a sufficient extent to be able to fold one of its ends over the adjacent side of the respective packet 3.

Figure 7:
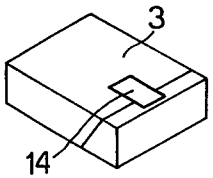
Figure 8:
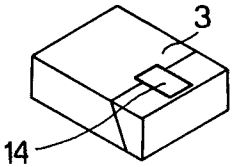

With regard to the second group, label 14 is applied in FIG. 7 transversely in an intermediate position across the hinging line. In FIG. 8, label 14 is applied transversely in an intermediate position on the closure line, on the face opposite the preceding face.

Figure 9:
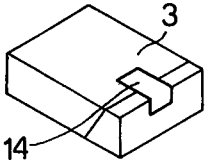
Figure 10:
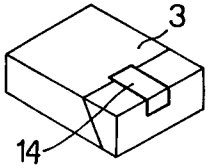

FIGS. 9 and 10 may be considered derived from FIGS. 7 and 8 respectively, by sliding label 14 so as to be able to fold one of its ends over the head of the respective packet 3.

Figure 11:
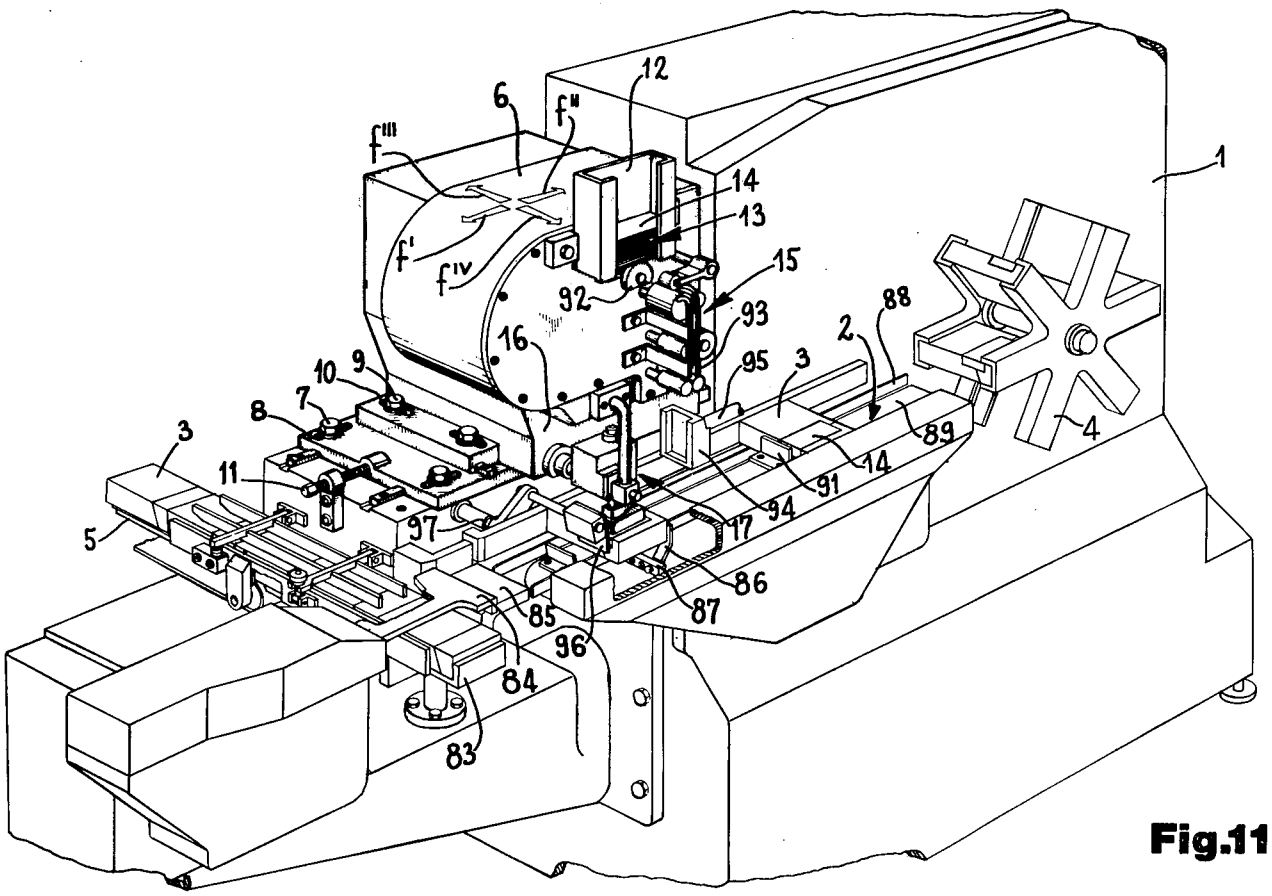
FIG. 11 is a perspective diagrammatic view of a known cellophane wrapping machine on which a labelling device in accordance with the invention is mounted.

With special reference to FIG. 11, the reference numeral 1 indicates overall a base of a known cellophane wrapping machine, on which a horizontal step conveyor 2 is provided to feed cigarette packets 3, arranged flat on conveyor 2 and transversely to their feeding direction, to a wrapping wheel 4.

Conveyor 2 is fed at its left hand end, with reference to FIG. 11, by a conveyor 5 orthogonal thereto.

A box 6 is mounted on base 1 and is adjustable relative thereto, for reasons which will be evident hereinafter, both longitudinally (arrows f', f'') and transversely (arrows f''', $f^{iv}$) to conveyor 2. This adjustment is made by firstly slackening a pair of fixing screws 7 passing through corresponding slots 8, and a pair of screws 9 passing through corresponding slots 10 respectively, and then adjusting a setting screw 11.

A container 12 accommodates a pile 13 of labels 14 and is rigid with box 6.

The reference numeral 15 indicates overall a device of known type for feeding individual labels from container 12 to their point of use. Box 6 and device 15, though indicated separately in the drawings, form part of a labelling device indicated overall by 17, and further comprising (FIG. 12) a casing or box 18 of vertical axis, bounded upperly and lowerly by walls 19 and 20 and laterally by walls 21 and 22 normal to an outer walls 16 of box 6, and by walls 23 and 24 normal to wall 16 (see also FIG. 13).

Device 17 is supported by a hollow shaft 25 emerging from box 6 in a direction normal to wall 16 and rigid with facing wall 23 of casing 18.

Hollow shaft 25 is driven by means described hereinafter to oscillate about 90° in both directions about its axis from and to a starting angular position.

From box 6 a horizontal shaft 26 extends whic is adapted to oscillate about its axis as shaft 25, and passing through hollow shaft 25 and wall 23, projects via roller cage 27 into casing 18 where its end is provided with a disc cam 28.

The drive means for shafts 25 and 26 contained in box 6 (see FIG. 13) are connected to a same shaft 29 which is parallel thereto and which is driven with continuous rotation by a motor (not shown) of the cellophane wrapping machine.

On the left and right hand side of shaft 29 there are keyed two disc cams 30 and 31 respectively, comprising annular projections 32 and 33.

Projections 32 and 33 are engaged respectively between pairs of idle rollers 34 and 35, which have their axes parallel to the axis of shaft 29 and are supported the first by a connection rod 36 and the second by a connection rod 37.

Connection rod 36, which at one end comprises a fork 38 defining a rectangular groove engaged by a slide block 39 rotatably mounted on shaft 29, is connected at its other end via a pin 40, the axis of which is parallel to shaft 26, to a lever 41 keyed on shaft 26.

Connection rod 37, which has one end in the form of a fork 42 defining a rectangular groove engaged by a slide block 43 mounted rotatably on shaft 29, is connected at its other end via a pin 44, the axis of which is parallel to shaft 25, to a lever 45 keyed on shaft 25.

In this manner, on rotating shaft 29, shafts 25 and 26 are moved with oscillating motion about their respective axes in a manner defined by the profiles 33 and 32 of cams 31 and 30.

Figure 12:
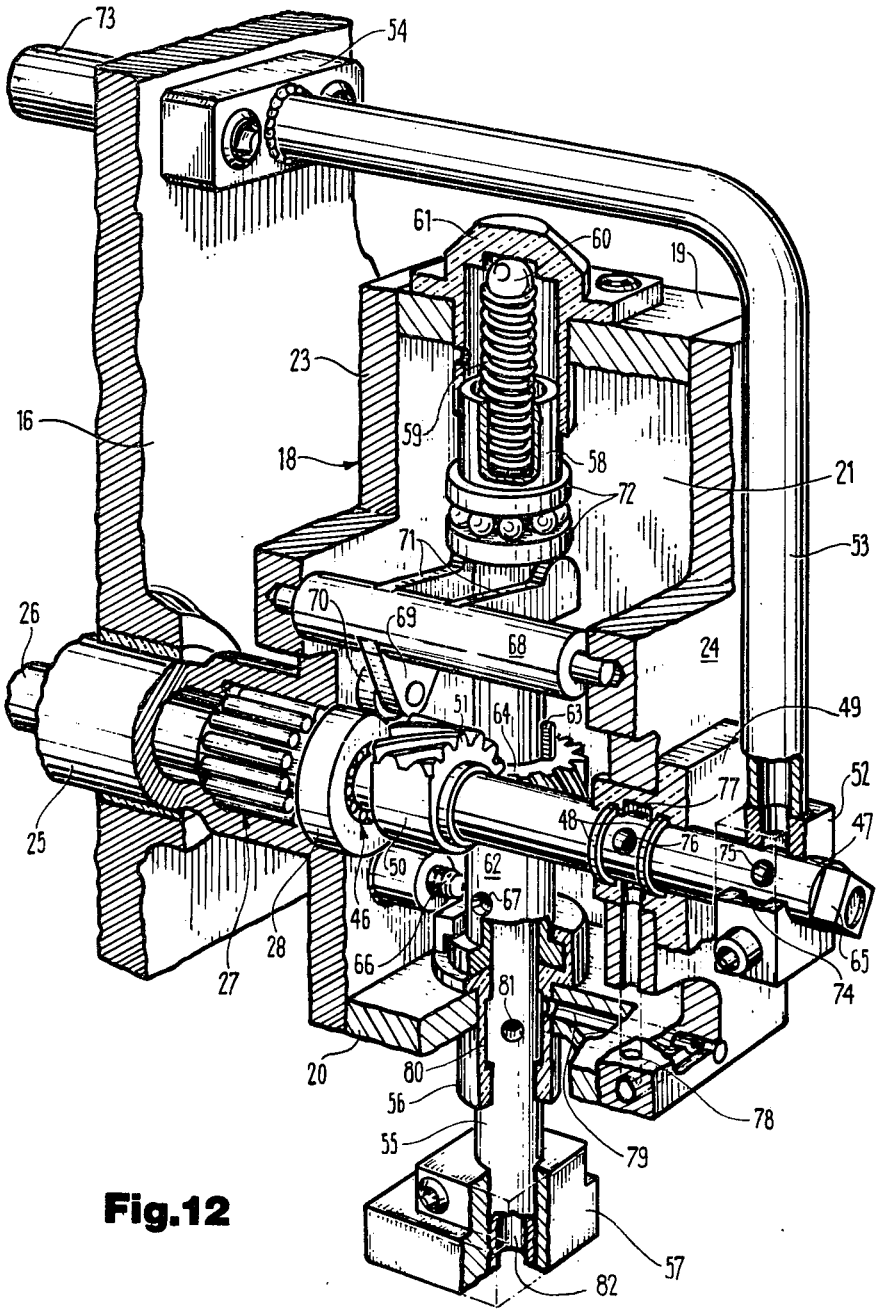
FIG. 12 is a perspective sectional enlarged view of the labelling device shown in FIG. 11.
Figure 13:
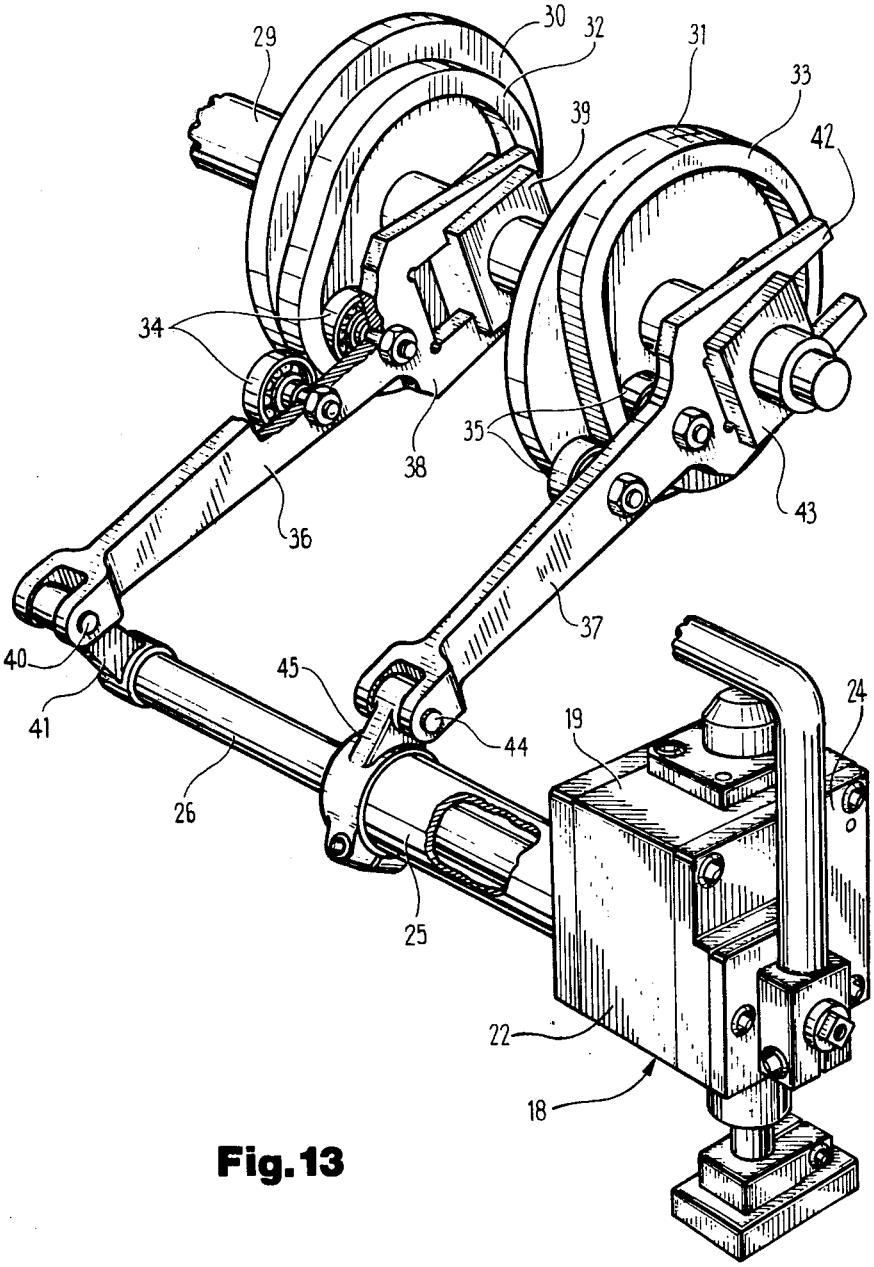
FIG. 13 is a perspective part-sectional enlarged view of a drive means forming part of the labelling device of FIGS. 11 and 12.

On the front face of said cam 28, when observing FIG. 12, there is provided a cylindrical cavity in which one end of a shaft 47 rests via a roller bearing 46, this shaft traversing coaxially to shaft 26, and via two seal rings 48, a cover 49 fixed to wall 24, the other end of shaft 47 projecting outwards.

On shaft 47 there is keyed a ring 50 arranged within casing 18 and comprising toothing, the teeth of which are inclined at about 45° over a sector 51 which embraces not less than 90° of its surface.

Shaft 47 is fixed via a parallelepiped block 52 at its right hand end, external to wall 24, to the lower end of the vertical portion of a hollow shaft 53 bent at a right angle.

The horizontal portion of hollow shaft 53 runs normal to wall 16 on which it is fixed via a block 54.

Casing 18 also contains a vertical shaft 55, the lower end of which projects below wall 20 through a bush 56 and has mounted thereon a block 57 of rectangular base.

An upper socket-shaped end 58 of shaft 55 houses a spiral spring 59 resting upperly, via a locking sphere 60, in a seat provided in a cover 61 to wall 19.

A tubular sleeve 62 is mounted on shaft 55 in the casing 18.

Sleeve 62 is mounted for rotating with bush 56, and is provided at its upper end, in a position corresponding with a vertical key 63 fixed into a shaft 66, with a gear 64 the teeth of which are inclined at about 45°, and which is designed to be adapted to be brought into engagement with toothed sector 51 of ring 50.

The purpose of key 63 is to enable shaft 55 to slide axially along tubular sleeve 62, while at the same time preventing any relative rotation therebetween.

Toothed sector 51 and gear 64 are coupled and decoupled by conventiently rotating shaft 47. To facilitate this operation, shaft 47 has an end portion 65 of square cross-section.

When sector 51 and gear 64 are coupled with one another, for each oscillation of 90° of shaft 25 and corresponding of casing 18, gear 64 rigid therewith is moved along the entire arc of toothed sector 51 such as to rotate together with shaft 55 and block 57 through about 90° in an anticlockwise direction as casing 18 makes its return oscillation.

When gear 64 is decoupled from sector 51, during oscillations in either direction of the casing 18 the gear 64 in no longer rotated. Under these conditions, tubular sleeve 62 rotatably rigid with shaft 55 is rotated through about 90° clockwise relative to the position of FIG. 12, so as to enable a screw 66 projecting from the inner face of wall 23 to become inserted in a corresponding bore 67. The purpose of this arrangement is to prevent any uncontrolled movement of shaft 55 during the various stages of operation.

Reference numeral 68 indicates a shaft parallel to shaft 47 and rotatably supported at its ends by walls 23 and 24 of casing 18, to act as a rotation spindle for a double armed lever, of which a first arm 69 is provided with an idle roller 70 with its axis parallel to shaft 68 and tangential to the profile of cam 28, and a second comprises two parallel rods 71 extending to the sides of shaft 55 and in contact, via a thrust ball bearing 72, with the upper end 58 of shaft 55.

It is apparent that the purpose of thrust bearing 72 is to annul friction between shaft 55 and rods 71 during relative rotation between these members.

By way of the connection just described, when idle roller 70 slides in contact with a cylindrical part of the profile of cam 28 as shaft 26 rotates, the double arm lever exerts a force via rods 71 on thrust bearing 72 against the action of spring 59, such as to maintain vertical shaft 55 and block 57 in a raised position.

As roller 70 passes from said cylindrical part to a flat part of the profile of cam 28, the double arm lever rotates clockwise about shaft 68, so enabling shaft 55 to slide axially downwards under the thrust of spring 59, as rods 71 incline.

A conduit connected to a suction source (non shown) via a tube 73 extends through hollow shaft 53, a groove 74 provided in block 52, and a bore 75 to reach the right hand hollow end of shaft 47.

A second bore 76 provided in shaft 47 in the region between rings 48 connects the suction source via ducts 77, 78 and 79 provided respectively in cover 49, wall 24 and wall 20, to a cavity 80 provided in bush 56 and then via a bore 81 to the lower hollow end of shaft 55, which is connected to atmosphere via a bore 82 in the base of block 57.

Following this mechanical description of labelling device 17, the known means for feeding cigarette packets 3 and labels 14 to the ares in which labelling device 17 operates are described hereinafter.

Each cigarette packet 3 disposed flat and fed with continuous motion in the direction of its major dimension reaches the end of conveyor 5 where it lies above a vertical elevator 83 which is at rest in its lower position.

Packet 3 is then raised by elevator 83 to the level of a horizontal pusher 84 which, during its outwards stroke in a direction normal to the conveyor 5, pushes packet 3 transversely to its major dimension across a bridge 85 on conveyor 2 until it lies against two blades 86.

The blades 86 are provided with oscillating movement by a bar 87 emerging from the base 1, and can therefore withdraw from said position in which they halt the packets 3, to a position in which they are disengaged therefrom.

Conveyor 2 feeding packets 3 to wrapping wheel 4 comprising two fixed packet-support strips 88 disposed upright on their longitudinal edges and a belt 89 wound endless on rollers 90 and moving with continuous motion between strips 88 at a lower level than the supporting base of packets 3.

A plurality of brackets 91 are fixed conveniently spaced apart on belt 89 for the purpose of contacting the upstream side of each packet 3, after pusher 84 and blades 86 have disengaged, and thrusting the packet along strips 88 towards wrapping wheel 4.

It is precisely during the halt of each packet 3 between the end of the outward stroke of pusher 84 and the arrival of a bracket 91 that labelling device 17 applies label 14. Labels 14 are individually sucked from the bottom of pile 13 by a circular sector 92 and are fed by this in the direction of their major dimension to a vertical track 93 of feed device 15, along which operate pairs of feed rollers and a pair of gumming rollers with their axes parallel to conveyor 5.

Each label 14 is retained beyond the lower end of track 93 by suction by the vertical side of a horizontal pusher 94.

Pusher 94, which is mounted at the end of a shaft 95 normal to feed track 93 and is provided with axial reciprocating motion, also transfers label 14 to device 17 which applies it to packet 3.

Figure 20:
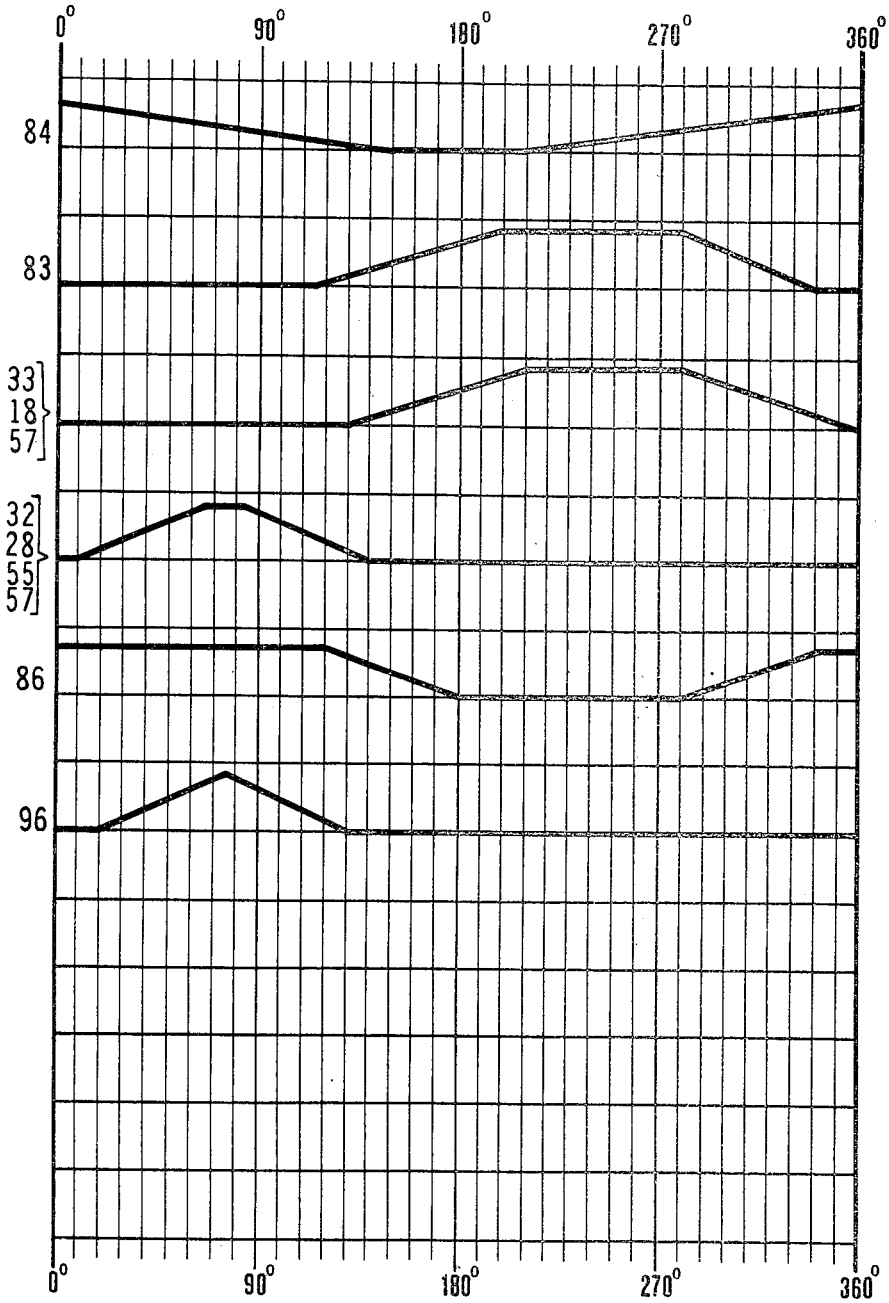
FIG. 20 shows diagrammatically the movements of a number of movable parts of the labelling device in accordance with the invention during a labelling cycle.

The operation of device 17 will now be described with reference to FIGS. 16, 17, 18 and 19, and to the diagrams of FIG. 20.

It is to be noted that the description which follows relates to the application of a label 14 to a respective packet 3 in one of the positions shown in FIGS. 3 to 6. It is also to be noted that, in the diagrams of FIG. 20, the horizontal lines represent halt times, ascending lines represent times of outward or active movement, and descending lines represent times of return movement.

In the case under examination, gear 64 is set decoupled from sector 51, and screw 66 is inserted into bore 67 in tubular sleeve 62.

Figure 16:
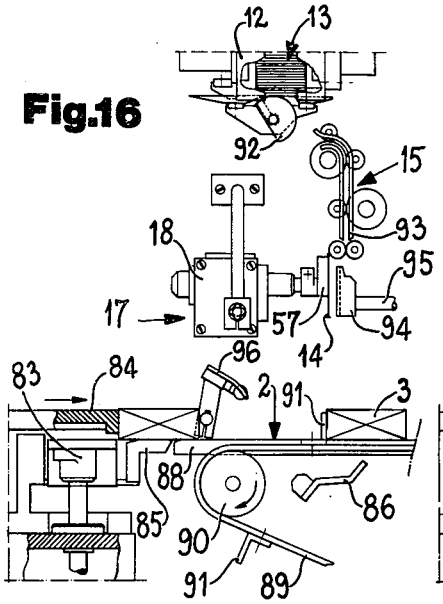
FIGS. 16, 17, 18 and 19 are diagrammatic views of the labelling device in accordance with the invention in four successive stages of the application of a label to a packet of cigarettes.

Casing 18 is brought from the position shown in FIG. 12 to the position shown in FIG. 16 by rotating hollow shaft 25 through about 90° in an anticlockwise direction.

Shaft 55 thus assumes a horizontal arrangement without rotating about its axis, and the basis of block 57 comes to face with pusher 94 arranged at the outlet of feed track 93.

A label 14 retained by suction by pusher 94 is then transferred by a movement from right to left of shaft 95 until in contact with the base of block 57.

The suction conduit connected to pusher 94 is then closed by means not shown in the figures, and label 14 is retained by block 57 as shaft 95 withdraws on its return stroke from left to right.

Figure 17:
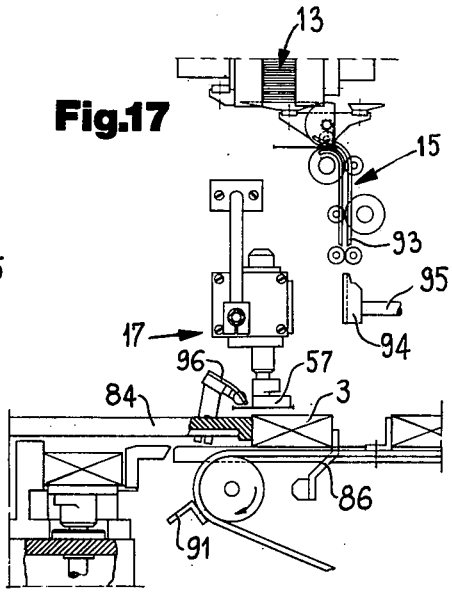
Figure 18:
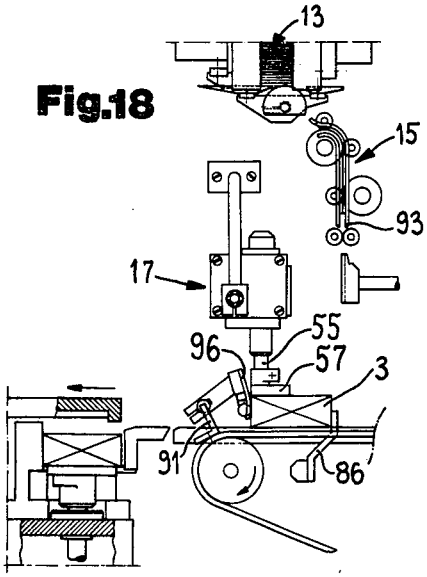
Figure 19:
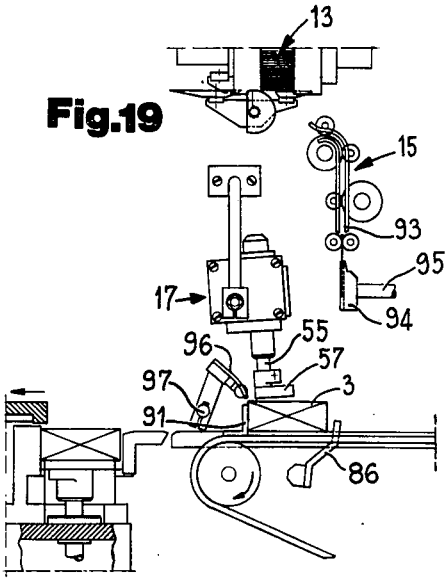

At this point, casing 18 returns to its starting vertical position, thus transferring label 14 to a position in which it is arranged with its major axis parallel to conveyor 2. As shown in FIG. 17, in this position, referred to as "ready-to-work" position, a first portion of the transferred label 14 is arranged above the respective packet 3 resting against blades 86, whereas a second portion of the transferred label 14 extends upstream of the trailing edge of packet 3.

Label 14 is then moved by block 57 so that its first portion adheres, by its gummed part, to the upper surface of the respective packet 3. This final movement of block 57 from the ready-to-work position to the application position is due cam 28, which causes shaft 55 to perform its outwards downwards stroke.

During the downward movement of shaft 55, folders 96 are operated to engage the aforementioned second portion of label 14 to fold said second portion about the trailing lateral upper edge of packet 3, and to stick the same to the trailing lateral surface of packet 3.

Folders 96 are then returned to their rest position, and a valve not shown in the figures, and connected upstream of tube 73, interrupts at this point the suction source acting on label 14 already applied to packet 3, and block 58 withdraws therefrom on the upward stroke of shaft 55.

The halt stage of the packet is concluded after disengagement of blades 86, on their return oscillation, on the arrival of a bracket 91 (see FIG. 19), which makes contact with packet 3 and thrusts it along conveyor 2 to wrapping wheel 4.

It is to be noted that any of the arrangements shown in FIGS. 3 to 6 may be obtained by suitably displacing box 6 in the direction of arrow $f''$ or $f^{iv}$ relative to conveyor 2.

Moreover, each of the arrangements shown in FIGS. 1 and 2 may be obtained by displacing box 6 in the direction of arrow $f'$ from the position shown in FIG. 11.

The cases shown in FIGS. 7, 8, 9 and 10 will now be considered, in which label 14 is applied longitudinally on the cigarette packet.

To apply label 14 in these arrangements, labelling device 17 is set for operation by disengaging screw 66 from bore 67 and then rotating shaft 55 through 90° anticlockwise, so as to move the same into the position shown in FIG. 12.

The toothed sector 51 of ring 50 is then moved into engagement with gear 64 by rotating shaft 47.

During passage of block 57 from its take-up position to its application position, label 14 is rotated through 90° about the axis of shaft 55, so that it becomes applied longitudinally to the major dimension of the respective packet 3 after the downward stroke of block 57.

Finally, as in the case of the arrangements of FIGS. 3, 4, 5 and 6, block 57 operates in combination with an oscillating hoe-shaped folder (not shown) which is similar to folder 96 and is disposed at that end of label 14 which projects beyond the head of packet 3.

Figure 14:
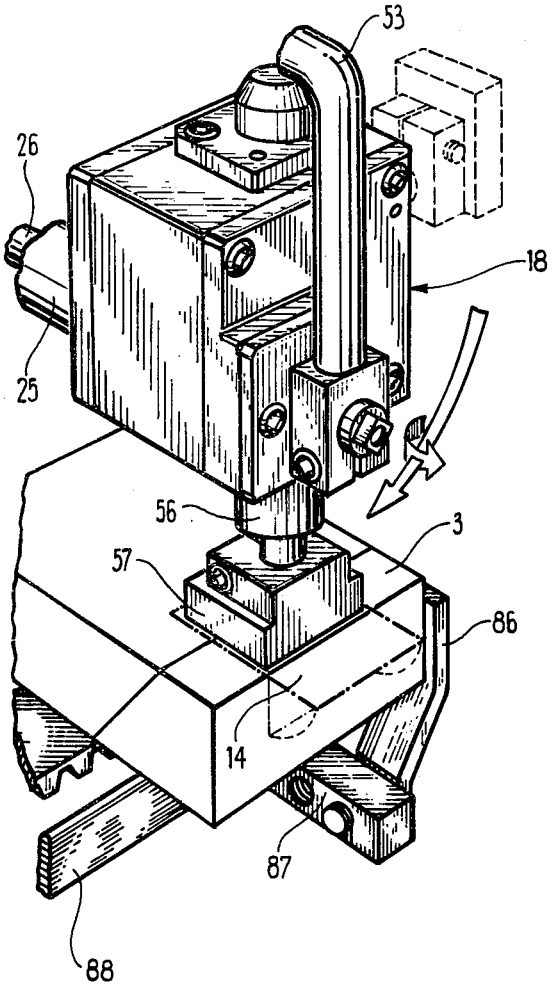
FIGS. 14 and 15 are perspective views of the labelling device in accordance with the invention in two different working arrangements.
Figure 15:
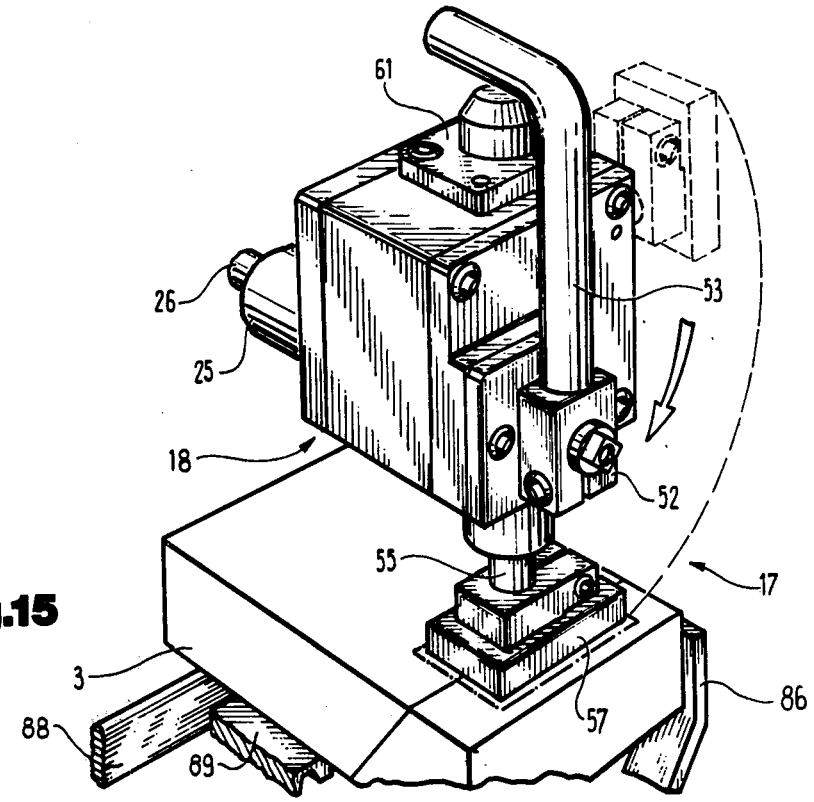

Again as in the case of FIGS. 3, 4, 5 and 6, to obtain the arrangements shown in FIGS. 9 and 10 box 6 is displaced normal to the conveyor 2 in the direction of the arrow $f^{iv}$ (see FIGS. 11 and 14) from the position occupied by it in the arrangements of FIGS. 7 and 8.

It is to be noted that, in order to correctly engage label 14 in the different types of arrangement shown in FIGS. 1 and 2, in FIGS. 3 to 6, in FIGS. 7 and 8, and in FIGS. 9 and 10 respectively, blocks 57 of different sizes may be connected to the end of shaft 56.

What I claim is:

1. A labelling device, particularly for applying a label to packets, in particular cigarette packets of the hinged lid type, arranged flat on a support plane and advanced transversely therealong in a step-by-step manner; the labelling device comprising a feeding device for feeding in succession individual labels to a take-up position; stop means for stopping in succession each said packet on said support plane in an application position at which the respective label is applied; a support member the position of which is adjustable relative to said support plane in two directions parallel thereto and at right angles to one another, one of said two directions being parallel to the direction of advancement of said packets; a casing connected to said support member so as to be rotatable relative thereto about an axis parallel to said support plane and at right angles to said advancement direction; first actuating means operable cyclically to oscillate said casing at a predetermined frequency about said axis through an angle; a main shaft extending through said casing in a rotatable and axially slidable manner and arranged at right angles to said axis; a label retaining means connected to said main shaft and oscillable therewith and said casing about said axis through said angle between said take-up position and a ready-to-work position arranged above said application position; second actuating means operable cyclically at the same frequency as said first actuating means to displace axially said label retaining means between said ready-to-work position and said application position; and transmission means adjustable between a coupled position and a decoupled position to transform, when arranged in said coupled position, the oscillation of said casing through said angle into a rotation of about 90° of said label retaining means about the axis of said main shaft.

2. A labelling device as claimed in claim 1, wherein said second actuating means comprise a cam member which is rotatable about the axis of rotation of said casing relative to the latter and said support member, and lever means pivoted to said casing and coupled with said shaft; said lever means being operated by said cam member to displace cyclically said shaft axially from said application position to said ready-to-work position against the action of resilient means thrusting said shaft axially towards said application position.

3. A labelling device as claimed in claim 1, wherein said transmission means comprise a helical spur gear keyed on to said shaft, a sector helical spur gear co-axial with said axis of rotation of said casing, and support means to support said sector gear in a fixed position relative to said support member during oscillation of said casing; said support means being adjustable in two different angular positions relative to said support member, and said two angular positions corresponding to said sector gear being meshed and, respectively, not meshed with said gear during oscillation of said casing.

* * * * *